US006777040B2

(12) United States Patent
Tatsuhashi et al.

(10) Patent No.: US 6,777,040 B2
(45) Date of Patent: Aug. 17, 2004

(54) RECORDING SHEET FOR INK JET PRINTER

(75) Inventors: Fumikazu Tatsuhashi, Shizuoka (JP); Nobuhiro Kubota, Shizuoka (JP); Shigeki Asai, Shizuoka (JP); Senichi Yoshizawa, Shizuoka (JP); Kazushige Katagiri, Shizuoka (JP); Minoru Tsuchida, Shizuoka (JP)

(73) Assignee: Tomoegawa Paper Co., LTD, Tokyo (JP)

( * ) Notice: Subject to any disclaimer, the term of this patent is extended or adjusted under 35 U.S.C. 154(b) by 0 days.

(21) Appl. No.: 10/230,253

(22) Filed: Aug. 29, 2002

(65) Prior Publication Data

US 2003/0049481 A1 Mar. 13, 2003

(30) Foreign Application Priority Data

Aug. 31, 2001 (JP) ..... 2001-263358
Nov. 29, 2001 (JP) ..... 2001-365303

(51) Int. Cl.[7] ..... B41M 5/00
(52) U.S. Cl. ..... 428/32.34; 428/32.3
(58) Field of Search ..... 428/195, 32.14, 428/32.24, 532, 689, 698, 32.34, 32.3

(56) References Cited

U.S. PATENT DOCUMENTS

| | | | | | |
|---|---|---|---|---|---|
| 5,474,843 | A | * | 12/1995 | Lambert et al. | 428/327 |
| 5,750,200 | A | * | 5/1998 | Ogawa et al. | 427/361 |
| 6,087,051 | A | * | 7/2000 | Shoji et al. | 430/14 |
| 6,089,704 | A | * | 7/2000 | Burns et al. | 347/105 |
| 6,180,238 | B1 | * | 1/2001 | Malhotra | 428/411.1 |
| 6,234,601 | B1 | * | 5/2001 | Hayashi et al. | 347/16 |
| 6,387,473 | B1 | * | 5/2002 | Sismondi et al. | 428/195 |
| 2001/0014381 | A1 | * | 8/2001 | Kaneko et al. | 428/195 |
| 2002/0171730 | A1 | * | 11/2002 | Nakahara et al. | 347/105 |

FOREIGN PATENT DOCUMENTS

| | | | |
|---|---|---|---|
| EP | 1 080 937 | A1 * | 3/2001 |
| JP | 07-276791 | | 10/1995 |
| JP | 08-295075 | | 11/1996 |

* cited by examiner

*Primary Examiner*—B. Shewareged
(74) *Attorney, Agent, or Firm*—Arent Fox, PLLC

(57) ABSTRACT

A recording sheet for an ink jet printer can improve both recording properties such as vividness of images, printing density, etc., and shelf life such as light resistance of images, ozone resistance, etc. The recording sheet for an ink jet printer comprises a base material and an ink receiving layer provided on at least one surface of the base material, in which the recording sheet contains oligosaccharide and divalent metallic salt.

18 Claims, No Drawings

RECORDING SHEET FOR INK JET PRINTER

BACKGROUND OF THE INVENTION

1. Field of the Invention

The present invention relates to a recording sheet for an ink jet printer, and in particular, relates to a recording sheet for an ink jet printer, in which printing density is high; printing is vivid; ink absorptivity is superior; light resistance, ozone resistance, and moisture resistance are superior; and ink is quickly absorbed. The recording sheet satisfies future high speed printing technique requirements.

2. Description of the Related Art

The use of ink jet printers has continued to increase in recent years because they have characteristics such as vividness of recorded images, quiet operation, ease of coloring, and the like. In order to prevent the jet nozzle thereof from being blocked due to drying of ink, an ink which is difficult to dry must be used in the ink jet printers. As ink having this property, water-soluble ink which is dissolved or dispersed with adhesive, dye, solvent, additives, or the like, in water, is generally employed. However, a symbol or an image formed on a recording sheet by employing the water-soluble ink is inferior to that of printed matter or silver halide photographs due to the use of pigment-type inks, from the viewpoint of light resistance, ozone resistance, and moisture resistance.

In recent years, as ink jet printers become inexpensive and printing images having high vividness and colorfulness are easily obtained, the requirements for ink absorptivity and color reproducibility have increased, and further improvement of printing density or further vivid coloring is thereby desired. In addition, the requirements for shelf life such as light resistance, ozone resistance, etc., are becoming severe. Therefore, completely satisfying these various requirements is an essential goal for recording sheets for ink jet printers.

In consideration of this present situation, improvements of recording sheets for ink jet printers have been researched. A method for improving color reproducibility and ink absorptivity by adding amino acids, for example, typified by Japanese Patent Applications, Publications No. 8-295075 and No. 7-276791, have been proposed. In addition, a method for improving light resistance of the images by using additives such as polyphenol, etc., has also been proposed. However, it has been confirmed that the addition of only these amino acids produces disadvantages such as decrease of vividness of images, reduction of light resistance and moisture resistance, etc., and that the addition of polyphenol produces yellowing over time, and all of the properties of printing density, vividness of images, and shelf life have not yet been sufficiently improved.

SUMMARY OF THE INVENTION

It is an object of the present invention to provide a recording sheet for an ink jet printer which can improve recording properties such as vividness of images, printing density, etc., and shelf life such as light resistance of images, ozone resistance, etc.

According to the results that the inventors have obtained from various research with regard to a recording sheet for an ink jet printer, the recording properties such as vividness of images, printing density, etc., and the shelf life such as light resistance of images, ozone resistance, etc., are improved very effectively by including an oligosaccharide and divalent metallic salt in the recording sheet for an ink jet printer, and the inventors have thereby attained the present invention. In other words, the recording sheet for an ink jet printer according to the present invention is characterized in that an ink receiving layer is provided on at least one side of a base material, and at least one of the ink receiving layer and the base material includes an oligosaccharide and divalent metallic salt. Furthermore, in the recording sheet for an ink jet printer of the present invention, it is preferable that the oligosaccharide and the divalent metallic salt be included in the ink receiving layer. In the following, the preferred embodiments according to the present invention will be explained in detail.

DETAILED DESCRIPTION OF THE PREFERRED EMBODIMENTS

The recording sheet for an ink jet printer according to the present invention is a laminated sheet in which at least one ink receiving layer is provided on at least one surface of a base material by a providing means such as a coating method, or the like. The ink receiving layer may be provided as two layers or more. In the following, materials which compose the base material and the ink receiving layer will be explained. The recording sheet for an ink jet printer of the present invention can exhibit superior recording properties and shelf life properties if the oligosaccharide and the divalent metallic salt are included not only in the ink receiving layer but also in any layer of the recording sheet for an ink jet printer; however, in the following, an embodiment which includes the oligosaccharide and the divalent metallic salt in the ink receiving layer will be explained.

(1) Base Material

As a base material provided for coating an ink receiving layer thereon according to the present invention, a base paper in which is mixed wood pulp such as chemical pulp such as LBKP, NBKP, or the like; mechanical pulp such as GP, PGW, RMP, TMP, CTMP, CMP, CGP, or the like; recycled pulp such as DIP, or the like; etc.; or synthetic fiber pulp such as that of polyethylene fiber, or lo the like, as a primary component, with pigment, sizing agent, fixer, yield improving agent, strengthening agent, or the like, alone or in combination, as necessary, and which is produced by using any type of apparatus such as a fourdrinier paper machine, cylinder paper machine, twin wire paper machine, or the like; can be preferably employed. In addition, a base paper provided with starch, polyvinyl alcohol, or the like using a size press; and a coated paper such as art paper, coated paper, cast coat paper, or the like, in which a coat layer is provided on these base papers, can be preferably employed. These base papers and coated papers may support an ink receiving layer directly, and in order to control smoothness of the surface thereof, a calender apparatus may be used such as a machine calender, TG calender, soft calender, or the like, before coating the ink receiving layer.

As a base material, a polyolefin resin layer may be provided on the surface of the above-described base paper, and film material of synthetic resin such as polyethylene, polypropylene, polyester, nylon, rayon, polyurethane, or the like; film material comprised of a mixture with these; and fiber-formed sheets of these synthetic resins may be employed.

(2) Ink Receiving Layer

The ink receiving layer in the recording sheet for an ink jet printer of the present invention is formed by a primary component comprising pigment and binder resin and various additives which are added as necessary, and in the present invention, it is preferable that the ink receiving layer contain divalent metallic salt in addition to oligosaccharide, so as to attain superior light resistance and ozone gas resistance. In the following, materials which can be employed in the ink receiving layer will be explained.

(A) Pigment

In an ink receiving layer according to the present invention, generally used pigments which are insoluble or slightly soluble in water can be employed alone or in combination. For example, a white inorganic pigment such as precipitated calcium carbonate, heavy calcium carbonate, kaolin, talc, calcium sulfate, barium sulfate, titanium dioxide, zinc oxide, zinc sulfide, zinc carbonate, satin white, aluminum silicate, diatomite, calcium silicate, magnesium silicate, synthetic amorphous silica, colloidal silica, colloidal alumina, pseudo-boehmite, aluminum hydroxide, alumina, lithopone, zeolite, hydrolytic halloysite, magnesium carbonate, magnesium hydroxide, or the like; an organic pigment such as styrene-type plastic pigment, acrylic-type plastic pigment, polyethylene, microcapsules, urea resin, melamine resin, or the like, etc., can be employed.

Of these pigments, as a white pigment which is a primary component contained in an ink receiving layer, a porous inorganic pigment is preferable since drying properties and absorptivity of an ink for an ink jet printer is excellent. For example, porous synthetic amorphous silica, porous magnesium carbonate, porous alumina, or the like, are preferably employed. Of these, since both printing quality and shelf life are satisfied in the present invention, the precipitation type or the gel type of porous synthetic amorphous silica with a specific surface area of about 200 to 600 $g/m^2$ can be preferably employed.

(B) Binder Resin

As binder resin contained in an ink receiving layer according to the present invention, polyvinyl alcohol, silyl modified polyvinyl alcohol, vinyl acetate, oxidized starch, etherificated starch, casein, gelatin, soybean protein; cellulosic derivative such as carboxymethyl cellulose, hydroxyethyl cellulose, or the like; conjugate diene type copolymer latex such as maleic anhydride resin, styrene-butadiene type copolymer, methylmethacrylate-butadiene copolymer, or the like; acrylic type polymer latex such as (meth)acrylic acid ester polymer, (meth)acrylic acid ester copolymer, or the like; vinylic type polymer latex such as ethylene-vinylacetate copolymer, or the like; functional group modified polymer latex comprised of monomers including functional groups such as a carboxy group, or the like of all types of these polymers; water-soluble adhesive consisting of thermosetting synthetic resin such as melamine resin, urea resin, or the like; synthetic resin type adhesive such as polymethylmethacrylate, polyurethane resin, unsaturated polyester resin, vinylchloride-vinylacetate copolymer, polyvinylbutyral resin, alkyd resin, or the like, can be preferably employed. These can be employed alone or in combination. The compounding ratio of the pigment to the binder resin in the ink receiving layer in the present invention is preferably 1:1 to 15:1, and is more preferably 2:1 to 10:1.

(C) Oligosaccharide

As an oligosaccharide contained in the recording sheet for an ink jet printing of the present invention, maltooligosaccharide and isomaltooligosaccharide can be employed. In the following, maltooligosaccharide and isomaltooligosaccharide will be explained.

The maltooligosaccharide in the present invention refers to carbohydrates having a polymerization degree of 2 or more in which units consisting of glucose are combined by $\alpha 1 \rightarrow 4$ bond. Specifically, maltose (glucose polymerization degree of 2) in which two glucose molecules are combined, maltotriose having a polymerization degree of 3, maltotetraose having a polymerization degree of 4, maltopentaose having a polymerization degree of 5, maltohexaose having a polymerization degree of 6, maltoheptaose having a polymerization degree of 7, etc., can be mentioned. In the present invention, maltooligosaccharide having a glucose polymerization degree of 2 to 10 is preferably employed, and in particular, maltooligosaccharide having a glucose polymerization degree of 2 to 7 is preferably employed, because effects such as recording property, light resistance and ozone resistance are superior. When glucose having a polymerization degree of 1 which is a unit is employed, vividness of images and ozone resistance are inferior, and the object of the present invention is not attained. In contrast, when maltooligosaccharide having a polymerization degree over 10 is employed, there is a problem in that light resistance and vividness of images are deteriorated.

The isomaltooligosaccharide in the present invention refers to carbohydrates in which units consisting of glucose are combined by $\alpha 1 \rightarrow 6$ bond, and in addition, carbohydrates having a bond other than the $\alpha 1 \rightarrow 4$ bond. Specifically, as an isomaltooligosaccharide having $\alpha 1 \rightarrow 6$ bond, isomaltose in which two glucose molecules are combined (glucose polymerization degree of 2), isomaltotriose and panose having a polymerization degree of 3, etc., can be mentioned, and as an isomaltooligosaccharide having a bond other than the $\alpha 1 \rightarrow 4$ bond, gentiooligosaccharide having $\beta 1 \rightarrow 6$ bond such as gentose, etc., nigerooligosaccharide having $\alpha 1 \rightarrow 3$ bond such as nigerose, etc., trehalose and glucosylsucrose, having $\alpha 1 \rightarrow 1$ bond, etc., can be mentioned. In the present invention, isomaltooligosaccharide having a glucose polymerization degree of 2 to 5 is preferably employed because effects such as recording characteristics, light resistance and ozone resistance are superior. When glucose having a polymerization degree of 1 which is a unit is employed, vividness of images and ozone resistance are inferior, and the object of the present invention is not attained. In contrast, when isomaltooligosaccharide having a polymerization degree over 5 is employed, there is a problem in that light resistance and vividness of images are deteriorated.

The oligosaccharides employed in the present invention can be prepared by heating starch in dilute acid to hydrolyze glucoside bonds, by amylolytic enzymes such as amylase to hydrolyze starch or amylose, or by transglycoside enzymes. The starch to be a raw material of the oligosaccharide can be optionally chosen from grain starch made from rice, corn, etc., and tuber starch made from potato, cassava, etc. Since the oligosaccharide prepared by the above procedures contains oligosaccharides having various degrees of polymerization, a separation and purification process is required in order to obtain oligosaccharide having a pure single degree of polymerization. However, a purification process for fractionating or isolating by using a gel filtration chromatography, etc., is desired in order to obtain oligosaccharide having a pure single degree of polymerization because oligosaccharides having a high degree of polymerization are difficult to crystallize.

As an oligosaccharides employed in the present invention, oligosaccharides having a pure single degree of polymerization obtained by the above purification can be employed, and in addition, a maltooligosaccharide mixture of maltooligosaccharides having a glucose polymerization degree of 2 or more and glucose which is obtained by, for example, carrying out saccharification reactions on starches using $\beta$-amylase and debranching enzyme, can also be employed. In the case in which such an oligosaccharide mixture having different degrees of glucose polymerization is employed, a maltooligosaccharide mixture comprising maltooligosaccharides having a glucose polymerization degree of 2 to 10 as a primary component is preferred, and of those, a maltooligosaccharide mixture in which the content of the maltooligosaccharides having a glucose polymerization degree of 2 to 7 is 50% by weight or more is preferred, and a maltooligosaccharide mixture in which the content is 70% by weight or more is even more preferable. Furthermore, an isomaltooligosaccharide mixture comprising isomaltooligosaccharides having a glucose polymerization degree of 2 to 5 as the primary component is preferred.

The content of the above oligosaccharide may be an optional proportion for total solids of the ink receiving layer, and it is preferably 0.5 to 30.0% by weight and is more preferably 5.0 to 20.0% by weight. When the content is under 0.5% by weight, the improvement effects such as ozone resistance of images, etc., are insufficient, and in contrast, when the content exceeds 30.0% by weight, ozone resistance and light resistance are sufficiently improved; however, further improvement is not obtained and there are problems in that water resistance and ink absorbability is decreased and in that coating film strength of the ink receiving layer is deteriorated. In addition, in the case in which these oligosaccharides are contained in the base material, they can be coated at about 0.2 to 15.0 g/m$^2$ by a size press, etc., or they can be added to the base material at 0.5 to 30.0% by weight.

(D) Divalent Metallic Salt

In the recording sheet for an ink jet printer of the present invention, by using a divalent metallic salt with an oligosaccharide, a synergistic effect can be obtained in which the effect due to addition of the oligosaccharide is further exhibited while superior ink absorbability is retained. In this case, the divalent metallic salt refers to a compound which produces a positive divalent metal ion when it is ionized by dissolving in water, etc. The divalent salt can be optionally selected, and specifically, a halide, hexafluorosilylate, sulfate, thiosulfate, acetate, phosphate, chloric acid salt, or nitric acid salt of typical elements such as zinc, magnesium, calcium, strontium, barium, gallium, indium, thallium, germanium, tin, lead, bismuth, etc., can be mentioned. Of these metals, zinc, manganese, and chromium, are preferred, and of these salts, chloride, sulfate, and acetate, are preferred, and in particular, compounds which combine these can be preferably employed. Specifically, zinc chloride, zinc sulfate, zinc acetate, magnesium chloride, magnesium sulfate, magnesium acetate, calcium chloride, calcium sulfate, calcium acetate, can be mentioned.

The content of the metallic salt relative to the total solid content of the ink receiving layer may be at any ratio, and preferably ranges from 1.0 to 40.0% by weight, and more preferably ranges from 5.0 to 20.0% by weight. When the content is less than 1.0% by weight, although the effects of recording properties, light resistance of images, and ozone resistance are confirmed, they are not sufficient. In contrast, when the content exceeds 40.0% by weight, light resistance and ozone resistance are sufficiently improved; however, further improvement is not anticipated, and there are problems in that water resistance and moisture resistance are decreased or in that strength of a coating film of the ink receiving layer is reduced. Furthermore, there is a problem in that recording quality of the ink jet recording is deteriorated. In addition, in order to achieve vivid printing images, the content range of the metallic salt is preferably 5.0 to 40.0% by weight to pigment, and is more preferably 10.0 to 20.0% by weight.

(E) Other Additives

Furthermore, as other additives added to the ink receiving layer, cationic dye fixing agent, pigment dispersing agent, thickener, fluidity improving agent, defoaming agent, foam inhibitor, surface lubricant, foaming agent, penetrating agent, color dye, color pigment, fluorescent brightening agent, UV absorber, antioxidant, antiseptics, water resistance agent, hardening agent, or the like, can be blended in an appropriate ratio as necessary.

Of these additives, in particular, it is preferrable that the cationic dye fixing agent be added since it cooperates with the oligosaccharide having an effect of improving light resistance and ozone resistance. As a cationic dye fixing agent, various cationic polymers can be employed, and specifically, polyethyleneimine salt, polyvinylamine salt, acrylamide copolymer, condensation polymer salt of secondary amine and epihalohydrin, etc., can be employed. In order to obtain all of the effects of superior ozone resistance, light resistance, and water resistance and to improve the effectiveness thereof, the solid content of the cationic dye fixing agent content and the oligosaccharide content in the ink receiving layer is preferably 2:1 to 1:4 and is more preferably 3:2 to 1:2.

The composition of the ink receiving layer according to the present invention is not limited to the above-described materials. In order to satisfy various properties such as light resistance or ozone resistance and to solve production problems such as adhesion to the base material, pigments falling off in the layer in the cutting process, or the like, the solid content of each material in the ink receiving layer is most preferably 30.0 to 60.0% by weight of pigment, 20.0 to 40.0% by weight of binder resin, 5.0 to 20.0% by weight of oligosaccharide, and 5.0 to 20.0% by weight of divalent metallic salt.

The ink receiving layer is formed on a base material by coating the coating material which was prepared by dissolving or dispersing in water or a suitable solvent, using various kinds of apparatuses such as a blade coater, roll coater, air knife coater, bar coater, rod blade coater, size press, or the like on-machine or off-machine as appropriate. The coating weight of the ink receiving layer in the one layer type is preferably 5.0 to 30.0 g/m$^2$, and is more preferably 5.0 to 20.0 g/m$^2$. In the case of the two layer type in which is provided the first ink receiving layer on a base material and in which is provided the second ink receiving layer on the first ink receiving layer, the coating weight of the first ink receiving layer is preferably 5.0 to 30.0 g/m$^2$, and is more preferably 5.0 to 20.0 g/m$^2$. In addition, the coating weight of the second ink receiving layer is preferably 5.0 to 15.0 g/m$^2$, and is more preferably 5.0 to 10.0 g/m$^2$. In the case in which the coating weight is below the above range, excellent ink absorptivity or fixativity is seldom obtained. In the case in which it is over the above range, problems such as powdering of the layer, decrease in productivity, increase in cost, or the like occurs. In particular, in the case in which the coating weight of the second ink receiving layer is more than 15.0 g/m$^2$, it is difficult for the ink to pass through to the second ink receiving layer, thereby causing blurring of ink, so that vividness of images is impaired. Therefore, it is preferred that the coating weight of the ink receiving layer be controlled according to the number of the ink receiving layers provided.

In the case in which two or more ink receiving layers are provided, the oligosaccharide may be contained in any of the ink receiving layers, or it may be contained in some of the ink receiving layers. In the case in which the oligosaccharide is contained in some ink receiving layers, in order to reduce the concentration difference between the layers, the content of the oligosaccharide contained in the layers is preferably at the same ratio. In addition, the divalent metallic salt may be contained in any of the ink receiving layers, or it may be contained in some of the ink receiving layers. Furthermore, the coated ink receiving layer may be finished, using a calender such as a machine calender, TG calender, super calender, soft calender, or the like.

The recording sheet for an ink jet printer according to the present invention is constructed as described above, and even the construction which provided only the ink receiving layer has satisfactory properties. Additionally, a glossiness adjusting layer may be provided on a surface of an ink receiving layer, for example, using a general specularity drum type cast coater, or the like, in order to obtain increased value. This glossiness adjusting layer has a preferably characteristic in which glossiness as measured by a 60° specular glossiness test according to the Japanese Industrial Standard Z8741 is 10 or more. As material of the glossiness adjusting layer, a mixture of materials of binder resin and pigment employed in the above ink receiving layer may be employed as a coating solution.

In order to maintain glossiness, it is preferable that the compounding ratio of the binding resin to the pigment in the glossiness adjusting layer be 5.0 to 50.0% by weight, and more preferably 5.0 to 30.0% by weight. Coating volume in which the glossiness adjusting layer exhibit superior glossiness without impairing the function of the ink receiving layer, is preferably 3.0 to 25.0 g/m$^2$, and is more preferably 5.0 to 15.0 g/m$^2$.

The glossiness adjusting layer in the present invention preferably includes colloidal silica as a pigment component. The glossiness can be optionally adjusted by employing the colloidal silica which consists of different size particles in an appropriate ratio. This glossiness adjusting layer can be adjusted by choosing the composition in an appropriate ratio so that the glossiness of the printed portion can be higher than that of the nonprinted portion, or conversely, can be lower than it.

EXAMPLES

Next, the effects according to the present invention will be explained by showing Examples and Comparative Examples.

1. Preparation of Maltooligosaccharide

Potato starch (produced by Wako Pure Chemical Industries, Ltd.) was hydrolyzed by α-amylase and β-amylase and a maltooligosaccharide mixture was formed. Then, the maltooligosaccharide mixture was fractionated by gel filtration chromatography, and maltooligosaccharides having a glucose polymerization degree of 1 to 10 were isolated for each degree of polymerization, and a maltooligosaccharide having a glucose polymerization degree of 11 or more were separated out. Thus, maltooligosaccharides each having one degree of glucose polymerization and maltooligosaccharide mixtures shown in Table 1 which optionally mixed the maltooligosaccharides each having one degree of glucose polymerization were prepared.

TABLE 1

| | Composition ratio (% by weight) | | | |
|---|---|---|---|---|
| | Polymerization degree of 1 | Polymerization degree of 2 to 3 | Polymerization degree of 4 to 7 | Polymerization degree of 8 or more |
| Maltooligosaccharide mixture 1 | 3 | 18 | 79 | 0 |
| Maltooligosaccharide mixture 2 | 5 | 36 | 59 | 0 |
| Maltooligosaccharide mixture 3 | 3 | 82 | 15 | 0 |
| Maltooligosaccharide mixture 4 | 25 | 60 | 15 | 0 |

2. Production of Recording Sheet for Ink Jet Printer

Recording sheets for an ink jet printer of Examples and Comparative Examples were produced using maltooligosaccharides obtained by the above procedures and isomaltooligosaccharides which are commercial products. Oligosaccharides and divalent metallic salts employed in Examples and Comparative Examples are shown in Table 2. The composition ratio described in the Examples was the weight ratio of dried solid.

Example 1

As a base material, wood free paper having a basic weight of 90.0 g/m$^2$ was employed. Coating materials for an ink receiving layer and for a glossiness adjusting layer, which were obtained by dissolving and dispersing the below-described materials in water, were coated on one surface of the base material in this order, and this were dried, and an ink receiving layer and a glossiness adjusting layer were formed. Thus, a recording sheet for an ink jet printer of Example 1 according to the present invention was formed. The coating volumes of the ink receiving layer and the glossiness adjusting layer were 10.0 g/m$^2$.

Coating Material for Ink Receiving Layer

Binder resin

PVA (trade name: PVA 117; produced by Kuraray Co., Ltd.), 25.0% by weight

White pigment

Silica (trade name: Fineseal X37B; produced by Tokuyama Co., Ltd., specific surface area: 300 m$^2$/g), 54.0% by weight Cationic dye fixing agent (trade name: Sumirez Resin 1001; produced by Sumitomo Chemical Co., Ltd.), 10.0% by weight Maltooligosaccharide Maltose (glucose polymerization degree: 2), 1.0% by weight Divalent metallic salt Magnesium chloride (specialty product), 10.0% by weight Coating Material for Glossiness Adjusting Layer Binder resin PVA (trade name: PVA117; produced by Kuraray Co., Ltd.), 40.0% by weight Colloidal Silica (trade name: Snowtex 30; produced by Nissan Chemical Industries, Ltd.), 60.0% by weight

Example 2

A recording sheet for an ink jet printer of Example 2 was formed in the same manner as in Example 1, using coating material for an ink receiving layer consisting of binder resin, white pigment, and cationic dye fixing agent in the same ratios as those of the ink receiving layer in Example 1, and maltose at 30.0% by weight and divalent metallic salt at 10.0% by weight to total solid content of the ink receiving layer.

Example 3

A recording sheet for an ink jet printer of Example 3 was formed in the same manner as in Example 1, using coating material for an ink receiving layer consisting of binder resin, white pigment, and cationic dye fixing agent in the same ratios as those of the ink receiving layer in Example 1, and maltose at 15.0% by weight and divalent metallic salt at 10.0% by weight to total solid content of the ink receiving layer.

Example 4

A recording sheet for an ink jet printer of Example 4 was formed in the same manner as in Example 1, except that maltohexaose (glucose polymerization degree of 6) was used instead of maltose in the ink receiving layer of Example 3.

Example 5

A recording sheet for an ink jet printer of Example 5 was formed in the same manner as in Example 1, except that maltodecaose (glucose polymerization degree of 10) was used instead of maltose in the ink receiving layer of Example 3.

Example 6

A recording sheet for an ink jet printer of Example 6 was formed in the same manner as in Example 1, except that zinc chloride (produced by Wako Pure Chemical Industries, Ltd.) was used instead of magnesium chloride in the ink receiving layer of Example 3.

Example 7

A recording sheet for an ink jet printer of Example 7 was formed in the same manner as in Example 1, except that calcium chloride (produced by Wako Pure Chemical Industries, Ltd.) was used instead of magnesium chloride in the ink receiving layer of Example 3.

Example 8

A recording sheet for an ink jet printer of Example 8 was formed in the same manner as in Example 1, except that magnesium sulfate (produced by Wako Pure Chemical Industries, Ltd.) was used instead of magnesium chloride in the ink receiving layer of Example 3.

Example 9

A recording sheet for an ink jet printer of Example 9 was formed in the same manner as in Example 1, except that magnesium acetate (produced by Wako Pure Chemical Industries, Ltd.) was used instead of magnesium chloride in the ink receiving layer of Example 3.

Example 10

A recording sheet for an ink jet printer of Example 10 was formed in the same manner as in Example 1, except that the maltooligosaccharide mixture 1 shown in Table 1 was used instead of maltose in the ink receiving layer of Example 3.

Example 11

A recording sheet for an ink jet printer of Example 11 was formed in the same manner as in Example 1, except that the maltooligosaccharide mixture 2 shown in Table 1 was used instead of maltose in the ink receiving layer of Example 3.

Example 12

A recording sheet for an ink jet printer of Example 12 was formed in the same manner as in Example 1, except that the maltooligosaccharide mixture 3 shown in Table 1 was used instead of maltose in the ink receiving layer of Example 3.

Example 13

A recording sheet for an ink jet printer of Example 13 was formed in the same manner as in Example 1, except that the maltooligosaccharide mixture 4 shown in Table 1 was used instead of maltose in the ink receiving layer of Example 3.

Example 14

A recording sheet for an ink jet printer of Example 14 was formed in the same manner as in Example 1, except that isomaltose (glucose polymerization degree of 2) was used instead of maltose in the ink receiving layer of Example 1.

Example 15

A recording sheet for an ink jet printer of Example 15 was formed in the same manner as in Example 1, except that isomaltose (glucose polymerization degree of 2) was used instead of maltose in the ink receiving layer of Example 2.

Example 16

A recording sheet for an ink jet printer of Example 16 was formed in the same manner as in Example 1, except that isomaltose (glucose polymerization degree of 2) was used instead of maltose in the ink receiving layer of Example 3.

Example 17

A recording sheet for an ink jet printer of Example 17 was formed in the same manner as in Example 1, except that isomaltotriose (glucose polymerization degree of 3) was used instead of maltose in the ink receiving layer of Example 3.

Example 18

A recording sheet for an ink jet printer of Example 18 was formed in the same manner as in Example 1, except that panose (glucose polymerization degree of 3) was used instead of maltose in the ink receiving layer of Example 3.

Example 19

A recording sheet for an ink jet printer of Example 19 was formed in the same manner as in Example 1, except that gentose (glucose polymerization degree of 2) was used instead of maltose in the ink receiving layer of Example 3.

Example 20

A recording sheet for an ink jet printer of Example 20 was formed in the same manner as in Example 1, except that nigerose (glucose polymerization degree of 2) was used instead of maltose in the ink receiving layer of Example 3.

Example 21

A recording sheet for an ink jet printer of Example 21 was formed in the same manner as in Example 1, except that trehalose (glucose polymerization degree of 2) was used instead of maltose in the ink receiving layer of Example 3.

Example 22

A recording sheet for an ink jet printer of Example 22 was formed in the same manner as in Example 1, except that glucosyl sucrose (glucose polymerization degree of 3) was used instead of maltose in the ink receiving layer of Example 3.

Example 23

A recording sheet for an ink jet printer of Example 23 was formed in the same manner as in Example 1, except that zinc chloride (produced by Wako Pure Chemical Industries, Ltd.) was used instead of magnesium chloride in the ink receiving layer of Example 16.

Example 24

A recording sheet for an ink jet printer of Example 24 was formed in the same manner as in Example 1, except that calcium chloride (produced by Wako Pure Chemical Industries, Ltd.) was used instead of magnesium chloride in the ink receiving layer of Example 16.

Example 25

A recording sheet for an ink jet printer of Example 25 was formed in the same manner as in Example 1, except that magnesium sulfate (produced by Wako Pure Chemical Industries, Ltd.) was used instead of magnesium chloride in the ink receiving layer of Example 16.

Example 26

A recording sheet for an ink jet printer of Example 26 was formed in the same manner as in Example 1, except that magnesium acetate (produced by Wako Pure Chemical Industries, Ltd.) was used instead of magnesium chloride in the ink receiving layer of Example 16.

Example 27

A recording sheet for an ink jet printer of Example 27 was formed in the same manner as in Example 1, except that isomaltooligosaccharide (glucose polymerization degree of 4, compound of further purified commercial products) was used instead of maltose in the ink receiving layer of Example 3.

Example 28

A recording sheet for an ink jet printer of Example 28 was formed in the same manner as in Example 1, except that isomaltooligosaccharide (glucose polymerization degree of 5, compound of further purified commercial products) was used instead of maltose in the ink receiving layer of Example 3.

Example 29

A recording sheet for an ink jet printer of Example 29 was formed in the same manner as in Example 1, except that isomaltooligosaccharide (glucose polymerization degree of 6 or more, compound of further purified commercial products) was used instead of maltose in the ink receiving layer of Example 3.

Comparative Example 1

A recording sheet for an ink jet printer of Comparative Example 1 was formed in the same manner as in Example 1, using coating material for an ink receiving layer consisting of binder resin, white pigment, and cationic dye fixing agent in the same ratios as those of the ink receiving layer in Example 1. Therefore, Comparative Example 1 did not contain oligosaccharide and divalent metallic salt.

Comparative Example 2

A recording sheet for an ink jet printer of Comparative Example 2 was formed in the same manner as in Example 1, using coating material for an ink receiving layer consisting of binder resin, white pigment, and cationic dye fixing agent in the same ratios as those of the ink receiving layer in Comparative Example 1, and magnesium chloride at 10.0% by weight to total solid content of the ink receiving layer. Therefore, Comparative Example 2 did not contain oligosaccharide.

Comparative Example 3

A recording sheet for an ink jet printer of Comparative Example 3 was formed in the same manner as in Example 1, except that glucose (glucose polymerization degree of 1, a unit of oligosaccharide) was used instead of maltose in the ink receiving layer of Example 3. Therefore, Comparative Example 3 did not contain oligosaccharide.

Comparative Example 4

A recording sheet for an ink jet printer of Comparative Example 4 was formed in the same manner as in Example 1, using coating material for an ink receiving layer consisting of binder resin, white pigment, and cationic dye fixing agent in the same ratios as those of the ink receiving layer in Example 1, and maltose at 15.0% by weight to total solid content of the ink receiving layer (not containing divalent metallic salt).

Comparative Example 5

A recording sheet for an ink jet printer of Comparative Example 5 was formed in the same manner as in Example 1, using coating material for an ink receiving layer consisting of binder resin, white pigment, and cationic dye fixing agent in the same ratios as those of the ink receiving layer in Example 16, and isomaltose at 15.0% by weight to total solid content of the ink receiving layer (not containing divalent metallic salt).

TABLE 2

| | Oligosaccharide (Polymerization degree) | Addition amount (wt %) | Metallic salts | Addition amount (wt %) |
|---|---|---|---|---|
| Example 1 | Maltose (2) | 1.0 | Magnesium chloride | 10.0 |
| Example 2 | Maltose (2) | 30.0 | Magnesium chloride | 10.0 |
| Example 3 | Maltose (2) | 15.0 | Magnesium chloride | 10.0 |
| Example 4 | Maltohexaose (6) | 15.0 | Magnesium chloride | 10.0 |

TABLE 2-continued

| | Oligosaccharide (Polymerization degree) | Addition amount (wt %) | Metallic salts | Addition amount (wt %) |
|---|---|---|---|---|
| Example 5 | Maltodecaose (10) | 15.0 | Magnesium chloride | 10.0 |
| Example 6 | Maltose (2) | 15.0 | Zinc chloride | 10.0 |
| Example 7 | Maltose (2) | 15.0 | Calcium chloride | 10.0 |
| Example 8 | Maltose (2) | 15.0 | Magnesium sulfate | 10.0 |
| Example 9 | Maltose (2) | 15.0 | Magnesium acetate | 10.0 |
| Example 10 | Maltooligosaccharide mixture 1 | 15.0 | Magnesium chloride | 10.0 |
| Example 11 | Maltooligosaccharide mixture 2 | 15.0 | Magnesium chloride | 10.0 |
| Example 12 | Maltooligosaccharide mixture 3 | 15.0 | Magnesium chloride | 10.0 |
| Example 13 | Maltooligosaccharide mixture 4 | 15.0 | Magnesium chloride | 10.0 |
| Example 14 | Isomaltose (2) | 1.0 | Magnesium chloride | 10.0 |
| Example 15 | Isomaltose (2) | 30.0 | Magnesium chloride | 10.0 |
| Example 16 | Isomaltose (2) | 15.0 | Magnesium chloride | 10.0 |
| Example 17 | Isomaltotriose (3) | 15.0 | Magnesium chloride | 10.0 |
| Example 18 | Panose (3) | 15.0 | Magnesium chloride | 10.0 |
| Example 19 | Gentose (2) | 15.0 | Magnesium chloride | 10.0 |
| Example 20 | Nigerose (2) | 15.0 | Magnesium chloride | 10.0 |
| Example 21 | Trehalose (2) | 15.0 | Magnesium chloride | 10.0 |
| Example 22 | Glucosyl sucrose (3) | 15.0 | Magnesium chloride | 10.0 |
| Example 23 | Isomaltose (2) | 15.0 | Zinc chloride | 10.0 |
| Example 24 | Isomaltose (2) | 15.0 | Calcium chloride | 10.0 |
| Example 25 | Isomaltose (2) | 15.0 | Magnesium sulfate | 10.0 |
| Example 26 | Isomaltose (2) | 15.0 | Magnesium acetate | 10.0 |
| Example 27 | Isomalto-oligosaccharide (4) | 15.0 | Magnesium chloride | 10.0 |
| Example 28 | Isomalto-oligosaccharide (5) | 15.0 | Magnesium chloride | 10.0 |
| Example 29 | Isomalto-oligosaccharide (6†) | 15.0 | Magnesium chloride | 10.0 |
| Comparative Example 1 | not added | — | not added | — |
| Comparative Example 2 | not added | — | Magnesium chloride | 10.0 |
| Comparative Example 3 | Glucose (1) | 15.0 | Magnesium chloride | 10.0 |
| Comparative Example 4 | Maltose (2) | 15.0 | not added | — |
| Comparative Example 5 | Isomaltose (2) | 15.0 | not added | — |

Subsequently, with regard to the recording sheets for an ink jet printer obtained in Examples 1 to 29 and the comparative recording sheets for an ink jet printer obtained in Comparative Examples 1 to 5, subjects for evaluation such as a color patch or the like were printed on these sheets using an ink jet printer (trade name: PM-800C; produced by Seiko Epson Corporation). Light resistance, ozone resistance, printing density, and vividness of images were evaluated by the means described below using these printing images, and the results are shown in Table 3.

Evaluation Means

1. Light Resistance

As an exposure test, each recording sheet for an ink jet printer which had printed thereon a magenta color patch was irradiated by UV radiation at 60 kJ/m$^2$ under these conditions (black panel temperature: 40° C.; relative humidity: 60%; emission of ultraviolet light at 340 nm: 0.18 W/m$^2$), using a xenon weather-o-meter (trade name: Ci-5000, produced by the Atlas Electric Devices Co.). The refraction density of the irradiated magenta color patch and the original were measured by a spectrophotometer (trade name: GRETAG SPM50; produced by Gretag Macbeth Corporation), and the light resistance was evaluated according to the following criteria.

Remaining ratio of refraction density

A: cases where the refraction density of the irradiated color patch was not less than 90% of the original refraction density B: cases where the refraction density of the irradiated color patch was not less than 80% and under 90% of the original refraction density C: cases where the refraction density of the irradiated color patch was less than 80% of the original refraction density 2. Ozone Resistance An environment having an ozone content of 10 ppm was prepared using a simple ozonizer, and each recording sheet for an ink jet printer on which was printed a cyan color patch was left in the environment for 10 hours. The refraction density of the tested cyan color patch and the original were measured by a spectrophotometer (trade name: GRETAG SPM50; produced by Gretag Macbeth Corporation), and the ozone resistance was evaluated according to the following criteria.

Remaining ratio of refraction density

A: cases where the refraction density of the tested color patch was not less than 85% of the original refraction density B: cases where the refraction density of the tested color patch was not less than 70% and under 85% of the original refraction density C: cases where the refraction density of the tested color patch was less than 70% of the original refraction density 3. Printing Density Yellow, magenta, cyan, red, green, blue, and black color patches were printed on each recording sheet for an ink jet printer, and the refraction density of each color patch was measured, using a spectrophotometer (trade name: GRETAG SPM50; produced by Gretag Macbeth Corporation), and the printing density was evaluated according to the following criteria.

Printing density

A: cases where the lowest value of the refraction densities of the color patches was not less than 1.70

B: cases where the lowest value of the refraction densities of the color patches was 1.60 to 1.69

C: cases where the lowest value of the refraction densities of the color patches was 1.59 or less 4. Vividness of Images An N1 portrait image of ISO/JIS-SCID (according to Japanese Industrial Standard X9201-1995) having very fine Standard Color Image Data was printed on each recording sheet for an ink jet printer by an ink jet printer, and the vividness of images was evaluated by visual observation according to the following criteria.

Evaluation of vividness of images

A: cases where the images were clear and vivid and the vividness of images was superior B: cases where problems in practical use were not observed C: cases where the images were dull and the vividness was insufficient

TABLE 3

| | Light resistance | Ozone resistance | Printing density | Vividness of images |
|---|---|---|---|---|
| Example 1 | B | B | A | A |
| Example 2 | A | A | B | B |
| Example 3 | A | A | A | A |
| Example 4 | A | A | A | A |
| Example 5 | B | B | B | A |
| Example 6 | A | A | A | A |
| Example 7 | A | A | A | A |
| Example 8 | A | A | A | A |
| Example 9 | A | A | A | A |
| Example 10 | A | A | A | A |
| Example 11 | A | A | A | A |
| Example 12 | A | A | A | A |
| Example 13 | A | A | A | A |
| Example 14 | B | B | A | A |
| Example 15 | A | A | B | B |
| Example 16 | A | A | A | A |
| Example 17 | A | A | A | A |
| Example 18 | A | A | A | A |
| Example 19 | A | A | A | A |
| Example 20 | A | A | A | A |
| Example 21 | A | A | A | A |
| Example 22 | A | A | A | A |
| Example 23 | A | A | A | A |
| Example 24 | A | A | A | A |
| Example 25 | A | A | A | A |
| Example 26 | A | A | A | A |
| Example 27 | A | A | A | A |
| Example 28 | A | A | A | A |
| Example 29 | B | B | B | B |
| Comparative Example 1 | C | C | C | C |
| Comparative Example 2 | B | C | B | C |
| Comparative Example 3 | B | C | B | C |
| Comparative Example 4 | C | B | B | C |
| Comparative Example 5 | C | B | B | C |

As is apparent from the results of the above tests, the recording sheets for an ink jet printer according to Examples 1 to 29 showed that essential characteristics, such as printing density and vividness of images, were very superior, and further superior properties were obtained in light resistance and ozone resistance. In contrast, in the comparative recording sheets for an ink jet printer according to Comparative Examples 1 to 5 which did not contain both oligosaccharide and divalent metallic salt, effects for improving light resistance and ozone resistance were not observed, and vividness of images and printing density were also inferior.

What is claimed is:

1. A recording sheet for an ink jet printer, comprising a base material, an ink receiving layer provided on at least one surface of the base material, and a glossiness adjusting layer provided on the ink receiving layer, wherein the ink receiving layer comprises oligosaccharide at 5 to 20% by weight and divalent metallic salt at 5 to 20% by weight and the glossiness adjusting layer comprises binder resin and colloidal silica.

2. A recording sheet for an ink jet printer according to claim 1, wherein the oligosaccharide includes at least one maltooligosaccharide having a glucose polymerization degree of 2 to 10.

3. A recording sheet for an ink jet printer according to claim 1, wherein the oligosaccharide is at least one selected from maltose, maltotriose, maltotetraose, maltopentaose, maltohexaose, and maltoheptaose.

4. A recording sheet for an ink jet printer according to claim 2, wherein the oligosaccharide is at least one selected from maltose, maltotriose, maltotetraose, maltopentaose, maltohexaose, and maltoheptaose.

5. A recording sheet for an ink jet printer according to claim 1, wherein the oligosaccharide includes at least one isomaltooligosaccharide having a glucose polymerization degree of 2 to 5.

6. A recording sheet for an ink jet printer according to claim 1, wherein the oligosaccharide is at least one selected from gentiooligosaccharide, nigerooligosaccharide, trehalose, and glucosylsucrose.

7. A recording sheet for an ink jet printer according to claim 5, wherein the oligosaccharide is at least one selected from gentiooligosaccharide, nigerooligosaccharide, trehalose, and glucosylsucrose.

8. A recording sheet for an ink jet printer according to claim 1, wherein the metal in the divalent metallic salt is at least one selected from zinc, magnesium, and calcium.

9. A recording sheet for an ink jet printer according to claim 2, wherein the metal in the divalent metallic salt is at least one selected from zinc, magnesium, and calcium.

10. A recording sheet for an ink jet printer according to claim 1, wherein the divalent metallic salt is at least one selected from chloride, sulfate, and acetate.

11. A recording sheet for an ink jet printer according to claim 2, wherein the divalent metallic salt is at least one selected from chloride, sulfate, and acetate.

12. A recording sheet for an ink jet printer according to claim 8, wherein the divalent metallic salt is at least one selected from chloride, sulfate, and acetate.

13. A recording sheet for an ink jet printer according to claim 5, wherein the metal in the divalent metallic salt is at least one selected from zinc, magnesium, and calcium.

14. A recording sheet an ink jet printer according to claim 5, wherein the divalent metallic salt is at least one selected from chloride, sulfate, and acetate.

15. A recording sheet for an ink jet printer according to claim 1, wherein the ink receiving layer further comprises pigment at 30 to 60% by weight and binder at 20 to 40% by weight.

16. A recording sheet for an ink jet printer according to claim 15, wherein the divalent metallic salt is comprised at 5 to 40% by weight to the pigment.

17. A recording sheet for an ink jet printer according to claim 1, wherein the ink receiving layer further comprises cationic dye fixing agent and the cationic dye fixing agent is comprised at weight ratio to the oligosaccharide of 2:1 to 1:4.

18. A recording sheet for an ink jet printer according to claim 15, wherein the ink receiving layer further comprises cationic dye fixing agent and the cationic dye fixing agent is comprised at weight ratio to the oligosaccharide of 2:1 to 1:4.

* * * * *